US005904838A

United States Patent [19]

Kalnes et al.

[11] Patent Number: 5,904,838

[45] Date of Patent: May 18, 1999

[54] PROCESS FOR THE SIMULTANEOUS CONVERSION OF WASTE LUBRICATING OIL AND PYROLYSIS OIL DERIVED FROM ORGANIC WASTE TO PRODUCE A SYNTHETIC CRUDE OIL

[75] Inventors: Tom N. Kalnes, La Grange; Robert B. James, Jr., Northbrook, both of Ill.

[73] Assignee: UOP LLC, Des Plaines, Ill.

[21] Appl. No.: 09/062,089

[22] Filed: Apr. 17, 1998

[51] Int. Cl.[6] ..... C10G 45/00; C10G 67/00; C10M 175/00

[52] U.S. Cl. ..... 208/179; 208/57; 208/97; 208/143; 208/144; 208/145; 208/210

[58] Field of Search ..... 208/57, 143, 144, 208/145, 97, 179, 210

[56] References Cited

U.S. PATENT DOCUMENTS

| | | | |
|---|---|---|---|
| 3,179,586 | 4/1965 | Honerkamp | 208/216 |
| 3,496,095 | 2/1970 | Lewis | 208/57 |
| 4,818,368 | 4/1989 | Kalnes et al. | 208/50 |
| 4,840,721 | 6/1989 | Kalnes et al. | 208/57 |
| 4,895,995 | 1/1990 | James et al. | 585/310 |
| 4,941,966 | 7/1990 | Merz et al. | 208/112 |
| 5,384,037 | 1/1995 | Kalnes | 208/95 |

*Primary Examiner*—Walter D. Griffin
*Assistant Examiner*—Tam Nguyen
*Attorney, Agent, or Firm*—Thomas K. McBride; John G. Tolomei; John G. Cutts, Jr.

[57] ABSTRACT

A process for the simultaneous conversion of waste lubricating oil and pyrolysis oil derived from organic waste to produce a synthetic crude oil by means of contacting the combined feed with a hot hydrogen-rich gaseous stream to increase the temperature of the combined feed to vaporize at least a portion of the distillable organic compounds contained therein which is immediately hydrogenated in a hydrogenation reaction zone. The resulting effluent from the hydrogenation reaction zone is then introduced into a hydroprocessing zone to produce higher hydrogen-content hydrocarbons and to remove heterogeneous components such as sulfur, oxygen, nitrogen and halide, for example. The resulting effluent is cooled and partially condensed to produce a gaseous stream containing hydrogen and gaseous water-soluble inorganic compounds and a liquid stream containing hydrocarbon compounds. The gaseous stream is scrubbed to remove the gaseous water-soluble organic compounds and to thereby produce a hydrogen-rich gaseous recycle stream.

9 Claims, 1 Drawing Sheet

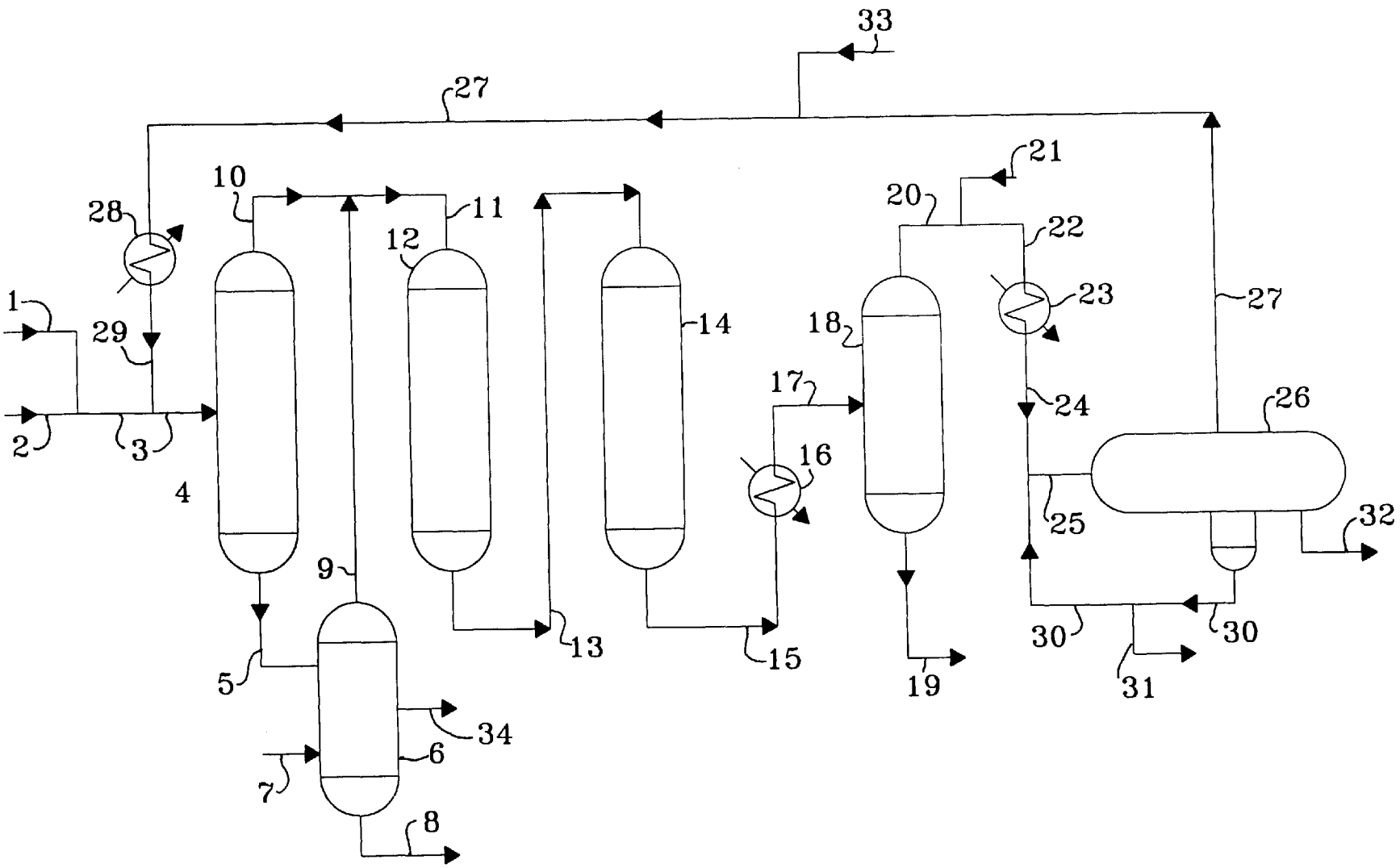
1
2
3
4
5
6
7
8
9
10
11
12
13
14
15
16
17
18
19
20
21
22
23
24
25
26
27
28
29
30
31
32
33
34

PROCESS FOR THE SIMULTANEOUS CONVERSION OF WASTE LUBRICATING OIL AND PYROLYSIS OIL DERIVED FROM ORGANIC WASTE TO PRODUCE A SYNTHETIC CRUDE OIL

FIELD OF THE INVENTION

The field of art to which this invention pertains is the recovery and conversion of waste lubricating oil and pyrolysis oil derived from organic waste to produce a synthetic crude oil containing hydrocarbonaceous compounds.

BACKGROUND OF THE INVENTION

There is a steadily increasing demand for technology which is capable of the conversion and recovery of useful products from discarded and unwanted materials such as waste lubricating oil and pyrolysis oil derived from organic waste. With the increased environmental emphasis for the conversion and recycle of unwanted and potentially environmentally damaging organic waste streams, there is an increased need for improved processes to convert organic waste streams to produce synthetic crude oils which may then subsequently be used to produce valuable, finished products such as lube oil blending stocks, petrochemical feedstocks, specialty oils and liquid transportation fuels. Desirable fuels include gasoline, diesel fuel and liquefied petroleum gas (LPG). Petrochemical feedstocks include feed to an ethylene plant. For example, during the disposal or recycle of potentially harmful organic waste streams or non-biodegradable organic waste streams, an important step in the total solution to the problem is to produce an organic stream or hydrocarbon which facilitates the ultimate resolution to produce product streams which may subsequently be handled in an environmentally acceptable manner. Therefore, those skilled in the art have sought to find feasible and economical techniques to convert waste materials such as spent lubricating oil and pyrolysis oil derived from organic waste to produce synthetic crude oils containing hydrocarbonaceous compounds.

INFORMATION DISCLOSURE

In U.S. Pat. No. 4,818,368, a process is disclosed for treating a temperature-sensitive hydrocarbonaceous stream containing a non-distillable component to produce a hydrogenated distillable hydrocarbonaceous product while minimizing thermal degradation of the hydrocarbonaceous stream.

SUMMARY OF THE INVENTION

The present invention provides a process for the simultaneous conversion of waste lubricating oil and pyrolysis oil derived from organic waste to produce a synthetic crude oil by means of contacting the combined feed with a hot hydrogen-rich gaseous stream to increase the temperature of the combined feed to vaporize at least a portion of the distillable organic compounds contained therein which is immediately hydrogenated in a hydrogenation reaction zone. The resulting effluent from the hydrogenation reaction zone is then introduced into a hydroprocessing zone to produce higher hydrogen content hydrocarbons and to remove heterogeneous components such as sulfur, nitrogen, oxygen and halide, for example. The resulting effluent is cooled and partially condensed to produce a gaseous stream containing hydrogen and gaseous water-soluble inorganic compounds and a liquid stream containing hydrocarbon compounds. The gaseous stream is scrubbed to remove the gaseous water-soluble organic compounds and to thereby produce a hydrogen-rich gaseous recycle stream. Important elements of the present invention are the relatively short time that the combined feed including pyrolysis oil derived from organic waste is maintained at an elevated temperature without the presence of catalyst, the avoidance of heating the feed stream via indirect heat exchange to preclude coke formation, the minimization of utility costs due to the integration of the heating, hydrogenation and hydroprocessing steps, and the ability to produce a useful and valuable synthetic crude oil from waste lubricating oil and pyrolysis oil derived from organic waste.

One embodiment of the invention may be characterized as a process for the simultaneous conversion of waste lubricating oil and pyrolysis oil derived from organic waste to produce a synthetic crude oil which process comprises: (a) contacting the waste lubricating oil and the pyrolysis oil derived from organic waste with a hot hydrogen-rich gaseous recycle stream to vaporize at least a portion thereof; (b) contacting the resulting admixture of hydrogen and vaporized waste lubricating oil and pyrolysis oil derived from organic waste with a hydrogenation catalyst in a hydrogenation zone operated at hydrogenation conditions to reduce the olefinicity and increase the thermal stability of the resulting hydrocarbons; (c) contacting the resulting hydrogen-hydrocarbon stream from step (b) with a hydroprocessing catalyst in a hydroprocessing zone operated at hydroprocessing conditions to produce higher hydrogen-content hydrocarbons containing lower concentrations of hetero-atoms; (d) condensing at least a portion of the resulting effluent from the hydroprocessing zone to produce a gaseous stream comprising hydrogen and gaseous, water-soluble inorganic compounds, and a liquid stream comprising hydrocarbons; (e) contacting the gaseous stream comprising hydrogen and gaseous, water-soluble inorganic compounds with an aqueous solution to recover the inorganic compounds and to produce a hydrogen-rich gaseous stream; and (f) recovering the liquid stream comprising hydrocarbons.

Other embodiments of the present invention encompass further details such as hydrogenation and hydroprocessing catalysts, aqueous scrubbing solutions and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

The present invention provides an improved integrated process for the conversion of waste lubricating oil and pyrolysis oil derived from organic waste. A wide variety of waste lubricating oils are contemplated for use in the invention including hydraulic fluids, heat transfer fluids, cutting oils, and internal combustion engine lubricants, for example. The pyrolysis oil derived from organic waste contemplated as a feedstock to the invention is preferably from post-consumer waste plastic which is pyrolyzed at a temperature greater than about 800° F. The pyrolysis oil derived from post-consumer waste plastic is thermally sensitive and characterized by very high olefin and di-olefin contents together with high concentrations of hetero compounds containing halogen, oxygen, sulfur and nitrogen. The pyrolysis oil derived from post-consumer waste plastic also contains insoluble, solid material such as char and ash that prevents it from being directly charged to a fixed bed reactor. In addition, the waste lubricating oil is likely to contain finely divided particulate matter. In accordance with the present invention, the pyrolysis oil derived from organic waste may also originate from waste tires and any other waste organic material. Preferred organic waste is selected from the group consisting of high density polyethylene, low density polyethylene, polystyrene, polyvinylchloride, and PET.

The presence of non-distillable components and finely divided particulate matter in the feed to the process of the present invention greatly increases the difficulty in producing a synthetic crude oil which may be successfully utilized for other uses. Non-distillable components tend to foul hot heat exchange surfaces which are used to heat the feed to conversion conditions, to form coke or in some other manner deactivate the catalyst thereby shortening its active life and to otherwise hinder a smooth and facile conversion operation. Particulate matter in a feed stream tends to deposit within the catalyst reaction zones and to plug fixed catalyst beds thereby reducing processing capacity and/or abbreviating the time on stream.

Once the temperature-sensitive feed stream is separated into a distillable stream and a heavy non-distillable stream, the resulting distillable stream is first introduced into a hydrogenation reaction zone and then a hydroprocessing reaction zone. In a preferred embodiment, the heavy non-distillable stream is stripped to further remove residual distillable components which are then introduced into the hydrogenation and hydroprocessing reaction zones. The resulting stream containing non-distillable components including finely divided particulate matter is recovered.

In accordance with the present invention, the combined feed stream of waste lubricating oil and pyrolysis oil derived from organic waste is contacted with a hot hydrogen-rich gaseous stream having a temperature greater than the hydrocarbonaceous stream in a flash zone at flash conditions thereby increasing the temperature of the feed stream and vaporizing at least a portion thereof to provide a vapor stream containing hydrogen, waste lubricating oil and pyrolysis oil derived from organic waste, and a heavy non-distillable stream. The hot hydrogen-rich gaseous stream preferably contains more than about 70 mole percent hydrogen and more preferably greater than about 90 mole percent hydrogen. The hot hydrogen-rich gaseous stream is multi-functional and serves as a heat source used to directly heat the combined fresh feed stream to preclude the coke formation that could otherwise occur when using an indirect heating apparatus such as a heater or heat-exchanger, a diluent to reduce the partial pressure of the feed during vaporization in the flash zone, a possible reactant to minimize the formation of polymers at elevated temperatures, a stripping medium and at least a portion of the hydrogen required in the hydrogenation and hydroprocessing reaction zones. In accordance with the present invention, the combined feed stream is preferably maintained at a temperature to prevent or minimize thermal degradation before being introduced into the flash zone. Depending upon the exact composition of the combined feed stream, the hot, hydrogen-rich gaseous stream is introduced into the flash zone at a temperature greater than the feed stream and preferably at a temperature from about 500° F. to about 1,200° F.

During the contacting, the flash zone is preferably maintained at flash conditions which include a temperature from about 400° F. to about 1,200° F., a pressure from about atmospheric to about 2,000 psig, a hydrogen to feed ratio of about 1,000 SCFB (168 normal $m^3/m^3$) to about 100,000 SCFB (10112 normal $m^3/m^3$) based on the fresh feed stream and an average residence time of the hydrogen-containing, hydrocarbonaceous vapor stream in the flash zone from about 0.1 seconds to about 50 seconds. A more preferred average residence time of the hydrogen-containing, hydrocarbonaceous vapor stream in the flash zone is from about 1 second to about 10 seconds.

The resulting heavy non-distillable portion of the feed stream is removed from the bottom of the flash zone as required to yield a heavy non-distillable stream. The heavy non-distillable stream may contain a relatively small amount of distillable components but since essentially all of the non-distillable components contained in the fresh feed stream are recovered in this stream, the term "heavy non-distillable stream" is nevertheless used for the convenient description of this stream. In a preferred embodiment, the heavy non-distillable stream is stripped to remove additional distillable components in order to maximize the production of the desirable components. The heavy non-distillable stream preferably contains a distillable component of less than about 20 weight percent and more preferably less than about 10 weight percent. Under certain circumstances with a feed stream not having an appreciable amount of liquid non-distillable components, it is contemplated than an additional liquid may be utilized to flush the heavy non-distillables from the flash zone. An example of this situation is when the fresh feed stream comprises a very high percentage of distillable compounds and relatively small quantities of finely divided particulate matter (solid) and essentially no liquid non-distillable component for use as a carrier for the solids. Such a flush liquid may, for example, be a heavy vacuum gas oil having a boiling range from about 700° F. (371° C.) to about 1000° F. (538° C.), an atmospheric resid having an initial boiling point greater than about 700° F. (371° C.) or a vacuum tower bottoms stream boiling at a temperature greater than about 1000° F. (538° C.). The selection of a flush liquid depends upon the composition of the fresh feed and the prevailing flash conditions in the flash separator and the volume of the flush liquid is preferably limited to that required for removal of the heavy non-distillable component.

The resulting hydrogen-containing, hydrocarbonaceous vapor stream is removed from the flash zone and is introduced into a catalytic hydrogenation zone containing hydrogenation catalyst and maintained at hydrogenation conditions. The catalytic hydrogenation zone may contain a fixed, ebullated or fluidized catalyst bed. This reaction zone is preferably maintained under an imposed pressure from about atmospheric (0 kPa gauge) to about 2000 psig (13,790 kPa gauge) and more preferably under a pressure from about 100 psig (689 kPa gauge) to about 1800 psig (12411 kPa gauge). Suitably, the hydrogenation reaction is conducted with a maximum catalyst bed temperature in the range from about 300° F. to about 850° F. selected to perform the desired hydrogenation conversion to reduce or eliminate the undesirable characteristics or components of the hydrocarbonaceous vapor stream. In accordance with the present invention, it is contemplated that the desired hydrogenation conversion includes, for example, dehalogenation, desulfurization, denitrification, olefin saturation and oxygenate conversion. Further preferred operating conditions include liquid hourly space velocities in the range from about 0.05 $hr^{-1}$ to about 20 $hr^{-1}$ and a hydrogen to feed ratio from about 200 standard cubic feet per barrel (SCFB) to about 100,000 SCFB, preferably from about 300 SCFB to about 100,000 SCFB.

In the event that the temperature of the hydrogen-containing, hydrocarbonaceous stream which is removed from the flash zone is not deemed to be exactly the temperature selected to operate the catalytic hydrogenation zone, it is contemplated that the temperature of the hydrogen-containing, hydrocarbonaceous stream may be adjusted either upward or downward in order to achieve the desired temperature in the catalytic hydrogenation reaction zone. Such a temperature adjustment may be accomplished, for example, by the addition of either cold or hot hydrogen.

The preferred catalytic composite disposed within the hereinabove-described hydrogenation zone can be characterized as containing a metallic component having hydrogenation activity, which component is combined with a suitable refractory inorganic oxide carrier material of either synthetic or natural origin. The precise composition and method of manufacturing the carrier material is not considered essential to the present invention. Preferred carrier materials are alumina, silica, and mixtures thereof. Suitable metallic components having hydrogenation activity are those selected from the group comprising the metals of Groups VIB and VIII of the Periodic Table, as set forth in the *Periodic Table of the Elements* E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active-metallic component, or components, is primarily dependent upon a particular metal as well as the physical and/or chemical characteristics of the particular hydrocarbon feedstock. For example, the metallic components of Group VIB are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating middle distillate hydrocarbonaceous compounds to remove nitrogen and sulfur may function effectively in the hydrogenation zone of the present invention. It is further contemplated that hydrogenation catalytic composites may comprise one or more of the following components: cesium, francium, lithium, potassium, rubidium, sodium, copper, gold, silver, cadmium, mercury and zinc.

The hydrocarbonaceous effluent from the hydrogenation reaction zone is then introduced into the catalytic hydroprocessing reaction zone in order to produce higher hydrogen content hydrocarbons containing lower concentrations of hetero-atoms. The catalytic hydroprocessing reaction zone may contain a fixed ebullated or fluidized catalyst bed and is preferably maintained under an imposed pressure from about atmospheric to about 2000 psig. Suitably, the hydroprocessing reaction is conducted with a maximum catalyst bed temperature in the range from about 400° F. to about 850° F. selected to perform the desired hydroprocessing conversion. Further preferred operating conditions include liquid hourly space velocities in the range from about 0.05 $hr^{-1}$ to about 20 $hr^{-1}$ and a hydrogen to feed ratio from about 200 SCFB to about 100,000 SCFB. The preferred hydroprocessing catalyst disposed within the hydroprocessing zone can generally be characterized as containing at least one metallic component having hydrogenation activity combined with a suitable refractory inorganic oxide carrier material of either synthetic or natural origin. The preparation of hydroprocessing catalysts is well known to those skilled in the art.

The hydrocarbonaceous effluent from the hydroprocessing reaction zone and containing hydroprocessed hydrocarbonaceous compounds and water-soluble inorganic compounds is cooled to produce a liquid stream comprising hydrocarbons and a gaseous stream comprising hydrogen, gaseous, water-soluble inorganic compounds and lower boiling hydrocarbonaceous compounds. The gaseous stream comprising hydrogen, gaseous, water-soluble inorganic compounds and lower boiling hydrocarbonaceous compounds is cooled and contacted with an aqueous scrubbing solution, and the resulting admixture is introduced into a separation zone in order to separate a spent aqueous stream, a liquid stream containing the lower boiling hydrocarbonaceous compounds and a hydrogen-rich gaseous phase. The contact with the aqueous scrubbing solution may be performed in any convenient manner and is preferably conducted by cocurrent, in-line mixing which may be promoted by inherent turbulence, mixing orifices or any other suitable mixing means. The aqueous scrubbing solution is preferably introduced in an amount from about 1 to about 100 volume percent based on the effluent from the hydroprocessing reaction zone. In accordance with the present invention, the aqueous scrubbing solution preferably contains a basic compound such as sodium carbonate, calcium hydroxide, ammonium hydroxide, potassium hydroxide or sodium hydroxide. In a preferred embodiment, the gaseous stream is contacted with an aqueous solution containing sodium carbonate which neutralizes and dissolves the water-soluble inorganic compounds. However, in general, the gaseous stream may be contacted with any suitable aqueous stream which accomplishes the objectives described herein. The recovered hydrogen-rich gaseous phase is recycled together with make-up hydrogen to provide at least a portion of the hot hydrogen-rich gaseous recycle stream.

The resulting liquid stream comprising hydrocarbons and the liquid stream containing the lower boiling hydrocarbonaceous compounds contain dissolved hydrogen and low molecular weight normally gaseous hydrocarbons and in accordance with the present invention, it is preferred that these streams be stabilized in a convenient manner, such as, for example, by stripping or flashing to remove the normally gaseous components to provide a stable product.

DETAILED DESCRIPTION OF THE DRAWING

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a waste lubricating oil stream having a non-distillable component is introduced into the process via conduit 1 and a pyrolysis oil stream derived from post-consumer waste plastic and also having a non-distillable component is introduced into the process via conduit 2 and the resulting admixture is transported via conduit 3 and is contacted with a hot hydrogen-rich gaseous recycle stream which is provided via conduit 29. This resulting admixture is introduced via conduit 3 into hot hydrogen flash separator 4. A hydrocarbonaceous vapor stream comprising hydrogen is removed from hot hydrogen flash separator 4 via conduit 10 and introduced via conduit 11 into hydrogenation reaction zone 12 without intermediate separation thereof. A heavy non-distillable stream is removed from the bottom of hot hydrogen flash separator 4 via conduit 5 and introduced into stripper zone 6. A stripping gas containing steam is introduced into stripper zone 6 via conduit 7 in order to remove entrained distillable components from the non-distillable stream. A stream containing distillable hydrocarbons is removed from stripper zone 6 via conduit 9 and is introduced into hydrogenation zone 12 via conduits 9 and 11. A stream of condensed steam is removed from stripper zone 6 via conduit 34 and recovered. A heavy non-distillable stream is removed from the bottom of stripper zone 6 via conduit 8 and recovered. The resulting hydrogenated hydrocarbonaceous stream is removed from hydrogenation reaction zone 12 via conduit 13 and is introduced into hydroprocessing reaction zone 14. The resulting hydroprocessed effluent from hydroprocessing reaction zone 14 is transported via conduit 15, partially condensed in heat-exchanger 16 and transported via conduit 17 into vapor-liquid separator 18. A stream containing condensed hydrocarbonaceous compounds is removed from vapor-liquid separator 18 via conduit 19 and recovered. A gaseous stream comprising hydrogen, gaseous, water-soluble inorganic compounds and lower boiling hydrocarbonaceous compounds is removed from vapor-liquid separator 18 via conduit 20 and contacted with an aqueous scrubbing solution provided via conduit 21 and the resulting admixture is transported via conduit 22 and introduced into heat-exchanger 23. A resulting cooled stream is removed from heat-exchanger 23 via conduit 24 and admixed with a recirculating aqueous scrubbing stream provided via conduit 30 and the resulting admixture is introduced via conduit 25 into vapor-liquid separator 26. A hydrogen-rich gaseous stream is removed from vapor-liquid separator 26 via conduit 27 and is admixed with make-up hydrogen provided via conduit 33 and the resulting admixture is transported via conduit 27 into heat-exchanger 28. The resulting heated hydrogen-rich gaseous stream is removed from heat-exchanger 28 and transported via conduits 29 and 3 as described hereinabove. A recirculating aqueous scrubbing stream is removed from vapor-liquid separator 26 via conduit 30 and is contacted with the stream provided via conduit 24 as described hereinabove. A net spent aqueous scrubbing stream is removed from the process via conduits 30 and 31. A stream containing lower boiling hydrocarbonaceous compounds is removed from vapor-liquid separator 26 via conduit 32 and recovered.

The process of the present invention is further demonstrated by the following illustrative embodiment. This illustrative embodiment is however not presented to unduly limit the process of this invention, but to further illustrate the advantages of the hereinabove-described embodiments. The following data were not completely obtained by the actual performance of the present invention, but are considered prospective and reasonably illustrative of the expected performance of the invention.

ILLUSTRATIVE EMBODIMENT

A waste oil feed in an amount of 18,792 mass units per hour (mu/hr) and a pyrolysis oil derived from post-consumer waste plastic in an amount of 2088 mu/hr is contacted with a hot, hydrogen-rich recycle gas in an amount of 26,949 mu/hr and at a temperature of 880° F., and the resulting admixture is passed to a hot flash zone operated at about 700° F. A vapor stream in an amount of 40,695 mu/hr is removed from the hot flash zone and introduced into a hydrogenation reaction zone containing a commercially-available hydrogenation catalyst operated at a temperature of about 650° F. and about 950 psig. A liquid stream in an amount of 7134 mu/hr is removed from the hot flash zone and stripped in a residue stripper with 2000 mu/hr of steam to produce a liquid hydrocarbonaceous stream in an amount of 5300 mu/hr which is also introduced into the hydrogenation reaction zone. A residue stream in an amount of about 1830 mu/hr is recovered from the residue stripper. The effluent from the hydrogenation reaction zone is directly introduced into the catalytic reaction zone containing a commercially-available hydroprocessing catalyst operated at a pressure of about 900 psig and a temperature of about 650° F. The effluent from the catalytic reaction zone is cooled to about 425° F. and introduced into a hot high pressure separator to produce a liquid hydrocarbonaceous product stream in an amount of about 15,560 mu/hr. A gaseous overhead stream in an amount of about 30,435 mu/hr is removed from the hot high pressure separator, admixed with an aqueous sodium carbonate solution in an amount of about 2600 mu/hr, cooled to ambient temperature and introduced into a cold high pressure separator. A gaseous hydrogen-rich stream is scrubbed with an aqueous sodium hydroxide solution to remove trace quantities of soluble inorganic halide compounds, removed from the cold high pressure separator, admixed with about 132 mu/hr of fresh make-up hydrogen and recycled to the hot flash zone as described hereinabove. A liquid hydrocarbonaceous product stream in an amount of about 2940 mu/hr is removed from the cold high pressure separator and recovered.

The foregoing description, drawing and illustrative embodiment clearly illustrate the advantages encompassed by the process of the present invention and the benefits to be afforded with the use thereof.

What is claimed:

1. A process for the simultaneous conversion of waste lubricating oil and pyrolysis oil derived from organic waste to produce a synthetic crude oil which process comprises:

(a) contacting said waste lubricating oil and said pyrolysis oil derived from organic waste with a hot hydrogen-rich gaseous recycle stream to vaporize at least a portion thereof;

(b) contacting the resulting admixture of hydrogen and vaporized waste lubricating oil and pyrolysis oil derived from organic waste with a hydrogenation catalyst in a hydrogenation zone operated at hydrogenation conditions to reduce the olefinicity and increase the thermal stability of the resulting hydrocarbons;

(c) contacting the resulting hydrogen-hydrocarbon stream from step (b) with a hydroprocessing catalyst in a hydroprocessing zone operated at hydroprocessing conditions to produce higher hydrogen-content hydrocarbons containing lower concentrations of heteroatoms;

(d) condensing at least a portion of the resulting effluent from said hydroprocessing zone to produce a gaseous stream comprising hydrogen and gaseous, water-soluble inorganic compounds, and a liquid stream comprising hydrocarbons;

(e) contacting said gaseous stream comprising hydrogen and gaseous, water-soluble inorganic compounds with an aqueous solution to recover said inorganic compounds and to produce a hydrogen-rich gaseous stream; and (f) recovering said liquid stream comprising hydrocarbons.

2. The process of claim 1 wherein at least a portion of said hydrogen-rich gaseous stream produced in step (e) is recycled to step (a).

3. The process of claim 1 wherein the weight ratio of said waste lubricating oil to said pyrolysis oil derived from organic waste is greater than about 6:1.

4. The process of claim 1 wherein said hot, hydrogen-rich gaseous recycle stream is maintained at a temperature in the range from about 600° F. to about 1050° F.

5. The process of claim 1 wherein said hydrogenation conditions include a temperature from about 300° F. to about 850° F., a pressure from about 100 psig (689 kPa gauge) to about 1800 psig (12411 kPa gauge), a liquid hourly space velocity from about 0.05 $hr^{-1}$ to about 20 $hr^{-1}$ and a hydrogen to feed ratio from about 200 standard cubic feet per barrel (SCFB) to about 100,000 SCFB.

6. The process of claim 1 wherein said hydroprocessing conditions include a temperature from about 400° F. to about 850° F., a pressure from about 100 psig (689 kPa gauge) to about 1800 psig (12411 kPa gauge), a liquid hourly space velocity from about 0.05 $hr^{-1}$ to about 20 $hr^{-1}$ and a hydrogen to feed ratio from about 200 standard cubic feet per barrel (SCFB) to about 100,000 SCFB.

7. The process of claim 1 wherein said aqueous solution contains a basic compound selected from the group consisting of sodium carbonate, calcium hydroxide, ammonium hydroxide, potassium hydroxide and sodium hydroxide.

8. The process of claim 1 wherein said pyrolysis oil derived from organic waste is thermally derived from post-consumer waste plastic.

9. The process of claim 1 wherein said organic waste is selected from the group consisting of high density polyethylene, low density polyethylene, polystyrene, polyvinylchloride, and PET.

* * * * *